United States Patent [19]

Wörwag

[11] Patent Number: 4,749,389

[45] Date of Patent: Jun. 7, 1988

[54] METHOD AND APPARATUS FOR HUMIDIFYING AND PURIFYING THE AIR OF A ROOM

[75] Inventor: Peter Wörwag, Romanshorn, Switzerland

[73] Assignee: Düpro AG, Romanshorn, Switzerland

[21] Appl. No.: 8,570

[22] Filed: Jan. 29, 1987

[30] Foreign Application Priority Data

Feb. 1, 1986 [DE] Fed. Rep. of Germany ..... 3603112

[51] Int. Cl.[4] ..... B01F 3/04

[52] U.S. Cl. ..... 55/259; 261/29; 261/91

[58] Field of Search ..... 261/91, 29; 55/259

[56] References Cited

U.S. PATENT DOCUMENTS

| | | | |
|---|---|---|---|
| 1,083,057 | 12/1913 | Clawson | 261/91 |
| 1,459,442 | 6/1923 | Cutler | 261/91 |
| 1,883,665 | 10/1932 | Fleisher | 261/91 |
| 2,221,010 | 11/1940 | Van Vliet | 261/91 |
| 2,607,571 | 8/1952 | Hession, Jr. | 261/91 |
| 2,796,241 | 6/1957 | Lhota | 261/91 |
| 2,984,464 | 5/1961 | Herr | 261/91 |
| 3,188,007 | 6/1965 | Myklebust | 261/91 |
| 3,229,450 | 1/1966 | Stern | 261/91 |
| 3,282,574 | 11/1966 | DePas | 261/91 |
| 3,304,066 | 2/1967 | Vieceli et al. | 261/91 |

FOREIGN PATENT DOCUMENTS

| | | | |
|---|---|---|---|
| 1454601 | 12/1971 | Fed. Rep. of Germany . | |
| 263477 | 12/1949 | Switzerland | 261/91 |
| 678477 | 9/1952 | United Kingdom | 261/91 |

*Primary Examiner*—Tim Miles

*Attorney, Agent, or Firm*—Becker & Becker, Inc.

[57] ABSTRACT

An apparatus for humidifying and purifying the air of a room. The apparatus has a water supply tank with a cover in which is mounted a motor. Disposed on the motor shaft is a fan wheel for generating a flow of air through the housing, a fan wheel for cooling the motor, and a pump tube. When the pump tube is rotated, it delivers a stream of liquid that leaves the pump tube as a free, sheet-like swirl of water through which the air flow is positively guided. Consequently, the air flowing through the swirl of water is purified and humidified.

22 Claims, 3 Drawing Sheets

METHOD AND APPARATUS FOR HUMIDIFYING AND PURIFYING THE AIR OF A ROOM

BACKGROUND OF THE INVENTION

1. Field of the Invention

The present invention relates to a method and apparatus for moistening or humidifying and cleaning or purifying the air of a room. The apparatus includes a housing that has at least one air inlet and one air outlet, with a lower part of the housing being embodied as a trough for a liquid. The apparatus also includes fan wheel means for generating an air flow through the housing, and a pump for producing a liquid flow within the housing.

2. Description of the Prior Art

Known apparatus of this general type serves exclusively, or at least essentially, for humidifying the air in closed rooms, such as is necessary especially in winter in artificially heated rooms to produce a natural air moisture content in conformity with the temperature. The heretofore known apparatus operates pursuant to various methods, with the air being supplied with water droplets, water vapor, or water from evaporation. One generally differentiates between two systems, namely vaporizers, where the water is artificially evaporated by supplying heat thereto, and evaporators that essentially evaporate the water at room temperature by enlarging the surface area.

Water vaporizers have the drawback that although they can supply water to the air, it is not possible to purify the air, because the water/air exchange takes place within the room. In addition, if poorly placed and/or overdosed, water vaporizers have the drawback that water droplets condense on objects in the room, especially on metal objects and windows.

These particular drawbacks do not occur with evaporators. In the latter, an airstream, generated for example by a motor-driven fan, is conveyed through a very porous mat that is continually sprayed with water. The air that flows through the moistening mat is divided into a plurality of small airstreams that take up water as they flow through the mat. Apparatus operating pursuant to this system has the drawback that the moistening mats, depending upon the lime content of the water that is used, often become unusable already after a very short period of time due to a buildup of lime. Furthermore, such moistening mats are a constant breeding ground for bacteria, so that considerable maintenance is required in order to avoid undesirable odors.

In order also to avoid these drawbacks, apparatus having no moistening mats were designed where the airstream was conveyed through a liquid stream that was preferably preliminarily swirled. One such apparatus is known from German patent No. 14 54 601—Katzman et al dated Dec. 2, 1971, corresponding to U.S. Pat. No. 3,283,478—Katzman et al dated Nov. 8, 1966, for a Humidifier. In this known apparatus, an airstream generated by a fan wheel, and a liquid stream produced by a rotary pump, were each conveyed to one side of a guide plate in the direction of a stationary impingement grate where the two streams were at least partially mixed together, and the air was enriched with water.

The drawback with this heretofore known apparatus is that a portion of the air flowing through the apparatus can escape without coming into contact with the liquid. At the impingement grate, on which a main portion of the liquid evaporation takes place, deposits easily form that greatly reduce the effectiveness of this grate. In addition, there is a danger of bacteria formation. Unfortunately, it is nearly impossible to clean the grate since it is accessible only from one side unless the pump is disassembled. A further drawback of this apparatus is that the air is not purified to any great extent; furthermore, the volume of the air that passes through is relatively low.

Proceeding from the last-mentioned state of the art, an object of the present invention is to provide an apparatus for purifying and humidifying the air of a room that avoids the aforementioned drawbacks and provides for a good purifying and humidifying effect of the air that passes through.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
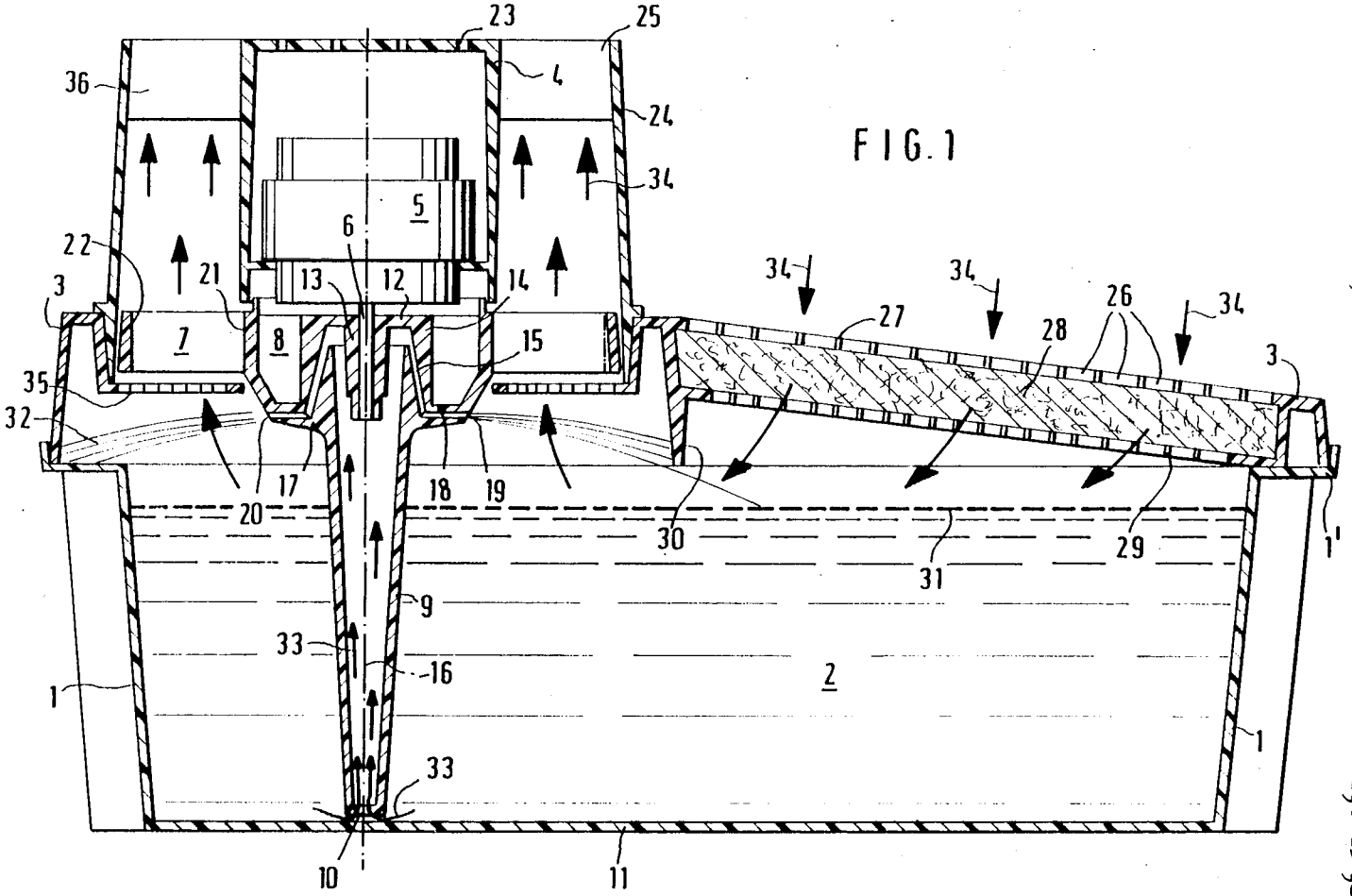
FIG. 1 is a very simplified vertical cross-sectional view through one exemplary embodiment of the inventive apparatus, taken along the rotor axis.

The apparatus of the present invention is characterized primarily in that a freely forming sheet-like stream of liquid is provided in a free space above the liquid level, with the air flow passing completely through this stream of liquid.

The inventive construction of the humidifying and purifying apparatus avoids the aforementioned drawbacks. At the same time, an intensive purifying and humidifying of the air that flows through the apparatus is achieved. The inventive construction makes it possible to have a high rate of flow while the overall size of the apparatus is relatively small.

During operation, the liquid, preferably water, is conveyed upwardly by the driven rotor of the rotary pump, where the liquid flows out of the outlet channels that are disposed radially about the axis of the rotor, and then flows into the free space between the surface of the liquid and the inside of the housing. An umbrella-like swirl of water results due to the essentially horizontal discharge of the water streams, accompanied by simultaneous rotation. At the same time, the fan wheel conveys a strong air flow through this rotating swirl of water. When the air flow meets the swirl of water the air flow is spun into a plurality of partial flows, so that an intensive, mutual swirling through of water and air takes place. In so doing, the air that is flowing through the swirl of water takes up a large amount of water; at the same time, dirt particles contained in the air flow are washed out. The washed-out dirt remains in the liquid cycle and settles to the bottom of the supply tank. Since the entire air flow, in order to leave the housing, must flow through the swirl of liquid, a high degree of humidification and a good purifying effect are achieved.

To protect the liquid cycle from larger particles of dirt, it is advantageous to dispose an air filter after the air inlet opening means in the direction of flow of air.

This air filter is preferably a replaceable filter unit that is mounted in the cover of the housing. A particularly advantageous construction results if the housing is essentially in two parts, including a trough-like lower housing part having a liquid supply and collection tank, and a cover for closing off the tank. The units for producing the air and liquid flows are then provided in the cover. With such an arrangement where only a single drive motor is provided for the pump and fan wheel, with a fan wheel for generating the air flow and therebelow the pump rotor for generating the liquid stream both being seated on the motor shaft, it is particularly advantageous if the air outlet opening is disposed in the cover concentric to the drive motor, because with such an arrangement the cross-sectional area of the outlet opening can be relatively large, as a result of which the resistance to flow of the air through the apparatus is reduced and a greater through put of air can be achieved. In this connection, the air inlet opening means is advantageously disposed next to the air outlet opening in the cover of the housing, so that in operation air flows through practically the entire surface of the cover, as a result of which it is even possible with smaller apparatus to have a great through put of air.

To prevent drops of liquid (mist) from being carried outwardly by the air flow, it is proposed pursuant to a further specific embodiment of the present invention to dispose a drop separator ahead of the air outlet opening in the direction of flow of the air, preferably even ahead of the fan wheel.

To facilitate handling of the apparatus, an opening is advantageously provided in the apparatus for filling the tank up with liquid; especially with large apparatus, an outlet is advantageously provided for draining and replacing the liquid. An appropriate indicator can be provided in the cover or in the wall of the housing to indicate the level of filling. This indicator can operate, for example, pursuant to the float principle. In order to assure sufficient cooling of the motor even when the apparatus is in constant operation, it is advantageous to provide a cooling air vein above the pump rotor, on the drive shaft of the motor, for cooling the latter. In order to achieve as rapid a mixture of the humidified air with the remaining air in the room, it is advantageous to provide appropriate guide surfaces within the air outlet opening. These guide surfaces cause the air to flow out in a laminar fashion. In this way, not only is the mixture of the air in the room enhanced, but the noise level of the apparatus is also reduced.

To achieve a constant air humidity, the apparatus is advantageously provided with a control and adjustment device that automatically turns the apparatus off, for example when a specific air moisture content has been achieved, and that again turns the apparatus on when the humidity drops below a certain value. The operating state and/or the desired and actual parameters can be indicated by an appropriate indicator disposed on the apparatus.

To facilitate cleaning of the apparatus, the inner surfaces of the apparatus are advantageously smooth. To positively guide the entire air flow through the swirl of liquid, it is proposed pursuant to a further embodiment of the present invention to provide a circumferential rib on the underside of the cover. During operation, this rib provides a lateral boundary for the stream range from all of the outlet channels, so that the air outlet opening, which is preferably disposed inwardly of this circumferential rib, is completely blocked-off from the swirl of liquid.

Pursuant to one particularly advantageous embodiment of the pump rotor, the upper end of the rotor tube is seated in, at a distance from, a member that is rigidly connected with the tube and surrounds the upper end thereof. This member, together with the tube, forms an annular channel that runs downwardly from the top and then outwardly, opening into the discharge channels. The latter are formed by a horizontal gap that is interrupted by ribs and that is provided between the underside of the member rigidly connected with the tube and an annular disk disposed on the outer side of the tube. The fan wheel for generating the air flow, and the fan wheel for generating the cooling air flow, can both be integrally formed with the rotor tube, with both fans wheels being coaxial to one another and being connected to the tube via the member that surrounds the upper end thereof. With this inventive embodiment, the air is advantageously guided into the air outlet opening, and the drive motor is reliably protected from spraying water by the upper part of the rotor.

Further specific features of the present invention will be described in detail subsequently.

DESCRIPTION OF PREFERRED EMBODIMENTS

Referring now to the drawings in detail, the illustrated apparatus includes an essentially two-part housing that has a smooth inner surface. The housing comprises a lower housing part 1, which is the water supply tank, and a cover 3. The lower housing part 1 is in the shape of a trough and serves as supply and collection tank that is filled with water 2 during operation. At the top, the supply tank 1 has a circumferential rim 1' that has an approximately L-shaped cross-sectional shape and projects laterally beyond the side walls of the tank 1.

The rim 1' forms the support surface for the housing cover 3, the outer edge of which, during operation, rests upon the horizontal surface of the rim 1' and is secured by the vertical portion of the rim 1' from shifting to the side.

Figure 3:
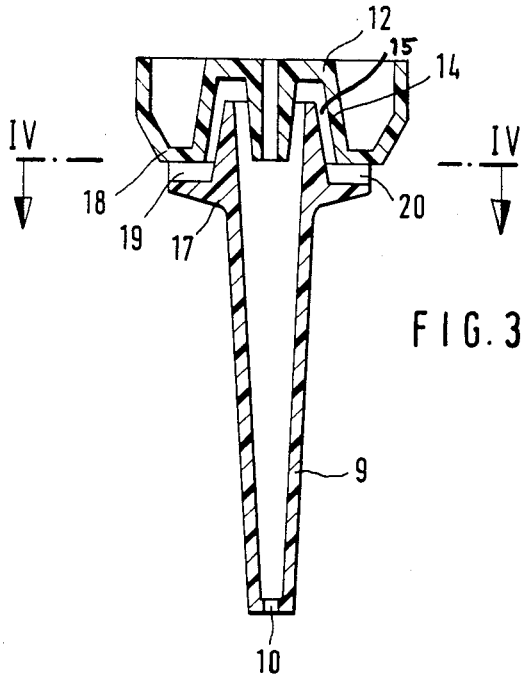
FIG. 3 is a detailed view of the rotor tube portion of the apparatus of FIG. 1.
Figure 4:
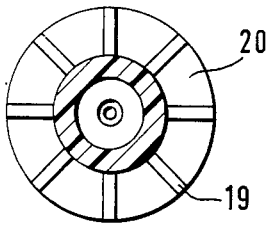
FIG. 4 is an enlarged cross-sectional view taken along the line IV—IV in FIG. 3.

A motor housing 4, in which is disposed a drive motor 5, projects beyond a portion of the top of the cover 3. The drive motor 5 has a motor shaft 6 that is directed vertically downwardly. Disposed on the motor shaft 6 are an outer fan wheel 7, an inner fan wheel 8, and the rotor 9 of a rotary pump. In the illustrated embodiment, the outer fan wheel 7 and the inner fan wheel 8 are advantageously integrally formed with the rotor 9. The rotor 9 of the rotary pump comprises a tube that tapers conically downwardly and that has an axial inlet opening 10 at its lower end. The length of the rotor tube 9 is such that the opening 10 is spaced slightly from the base 11 of the supply tank 1 when the cover 3 is placed on the latter. The tube 9 extends upwardly to within the inner fan wheel 8, where it ends at a distance from an annular disk 12. Near its inner side, the annular disk 12 has a downwardly directed, hollow cylindrical part 13 with which the annular disk 12, as well as the parts 7, 8, and 9 that are fixedly connected thereto, are nonrotatably connected to the drive shaft 6 of the motor 5. An approximately hollow cylindrical, downwardly directed part 14 is connected near the outer periphery of the annular disk 12. This part 14 surrounds the upper part of the tube 9, with spacing, with the inner periphery of the part 14 widening conically from the top toward the bottom. In the upper region of the tube 9, where it is surrounded with spacing by the part 14, the outer surface of the tube 9 has a diameter that increases from the top toward the bottom, so that an annular channel 15 is formed between the part 14 and the upper part of the tube 9. The distance of the annular channel 15 from the axis of rotation of 16 of the rotor increases from the top toward the bottom. The annular channel 15 is delimited by an annular disk 17 that extends perpendicular to the axis of rotation 16 and is disposed on the outer periphery of the tube 9. The disk 17 is spaced from a similarly annular disk 18 that is connected to the bottom of the approximately hollow cylindrical part 14 on the outside thereof. The annular disks 17 and 18 are interconnected by radially extending ribs 19 so that outlet channels 20 are formed between the disks 17 and 18. These outlet channels 20 are disposed in a star-shaped and radial manner relative to the axis of rotation 16 (see FIGS. 1, 3, and 4).

Via the ribs 19, the rotor 9 is connected to the motor shaft 6 via the parts 18, 14, 12, and 13. Connected to the outer periphery of the annular disk 18 is a hollow cylindrical part 21 that first extends upwardly and outwardly, is then directed cylindrically upwardly, and ends approximately at the level of the annular disk 12. Disposed between the inner hollow cylindrical part 14, the annular disk 18, and the outer hollow cylindrical part 21 are a plurality of fan blades that are disposed radially relative to the axis of rotation 16 and that form the inner fan wheel 8. Disposed on the straight outer surface of the hollow cylindrical part 21 are a plurality of fan blades that are similarly radially disposed relative to the axis of rotation 16 and that form the outer fan wheel 7. In the illustrated embodiment, the fan blades of the outer fan wheel 7 are provided on the outer periphery with a stabilizing ring 22 that extends over the entire height of the fan blades.

The inner fan wheel 8 serves for cooling the motor 5, and conveys cooling air into the motor housing 4. The air can exit at the top of the housing 4 via appropriate ventilation openings 23. The motor housing 4 is approximately cylindrical and is connected to a hollow cylindrical cover part 24 of greater diameter by not-illustrated connecting ribs. In the illustrated embodiment, the cover part 24 is securely seated in an appropriate recessed portion in the cover 3. The annular space between the motor housing 4 and the hollow cylindrical cover part 24 forms an air outlet opening 25 for the air flow 34 that can be produced by the outer fan wheel 7. Air inlet means 26 for this air flow 34 is provided in the cover 3 next to the hollow cylindrical cover part 24. In the illustrated embodiment, the air inlet means 26 is completed by a cover grating 27 that is disposed flush in the upper side of the cover 3. Disposed below the cover grating 27 is an air filter 28 that is completed on the underside by a further cover grating 27. For this purpose, as can be seen in FIG. 1, the cover 3 has appropriate rims in which are held the cover gratings 27 and 29 and the air filter 28 that is disposed therebetween. The air inlet means 26 can extend over nearly the entire surface of the cover 3 externally of the cover part 24. In this way, despite the provision of an air filter 28, little resistance to the flow-through of air results.

Provided on the underside of the cover 3, concentric to the axis of rotation 16, is a downwardly directed, circumferential rib 30 that extends to a level that is in the region between the outlet channels 20 and the surface 31 of the water 2. In the illustrated embodiment, on the outer side of the cover 3 (the left side in FIG. 1), the rib 30 merges into the rim of the cover. The rib 30 is embodied and disposed in such a way that the streams of water 32, which during operation exit the outlet channels 20 and form sheet-like swirls of water due to the rotation of the rotary pump rotor 9, extend to the inner side of the rib 30, so that the air flow 34 that flows through housing can reach the air outlet opening 25 only by passing through the swirl of water. A drop separator 35, which in this embodiment is ring-shaped, is disposed within the rib 30 below and at a slight distance from the outer fan wheel 7. The outer periphery of the separator 35 is secured to a downwardly directed rib of the cover 3. The drop separator 35 extends nearly to the hollow cylindrical part 21 that is disposed between the inner and outer fan wheels 8 and 7. During operation, the water droplets that are carried along by the air flow 34 are separated by the drop separator 35 and are returned to the supply tank 1.

During operation of the inventive apparatus the motor 5 is driven, thereby turning the parts 7, 8, and 9 that are securely connected to the motor shaft 6. In so doing, due to the inner fan wheel 8, a cooling airstream is provided through the motor housing 4. This airstream exits through the ventilation openings 23 at the top of the housing 4. By rotating the rotor tube 9, which operates as a pump tube pursuant to the rotary pump principle, a stream of water 33 is provided within the tube 9. During rotation, the lower part of the pump tube 9 that extends into the supply of liquid 2 in the tank 1, due to the adhesive capacity on the inner surface of the tube and the centrifugal forces that result during rotation, conveys the stream of water 33, which first rises from the inlet opening 10 of the pump tube 9 due to the communicating effect and then rises upwardly to the end of the tube due to the described pump affect, where, due to the centrifugal force, it is pressed outwardly and then changes direction by 180°. After this change of direction, the stream of water 33, due to centrifugal force flows through the annular channel 15 where, due to the high centrifugal forces that are produced at this location due to the great circumferential speed, the water is again accelerated and finally obtains its greatest acceleration in the approximately horizontal outlet channels 20. The acceleration within the annular channel 15 is at that location advantageously enhanced by the force of gravity. The stream of water 33, which is divided into numerous streams of water 32 by the outlet channels 20, due to the rotation of the rotor 9, is formed into a vigorously pulsating, umbrella-like swirl of water. This swirl of water fills the region between the outlet channels 20 and the circumferential rib 30. The air flow 34 produced by the rotation of the outer fan wheel 7 must pass through the swirl of water 32. In so doing, the air flow 34 that passes through the swirl of water 32 is divided into a number of swirling airstreams that experience an intensive mixing as they pass through the swirl of water 32, so that the air takes up a lot of water while at the same time dirt particles are washed out of the air. The air flow 34 that flows through the apparatus is drawn in through the air inlet means 26, whereafter larger particles of dirt are retained in the air filter 28. The thus preliminarily purified air flow 34 flows between the underside of the cover and the surface 31 of the water to below the umbrella-like swirl of water 32, through which the air passes. After passing through the drop separator 35, the air exits through the air outlet opening 25 and again passes into the atmosphere. During this process, the rib 30 prevents any of the air flow 34 from exiting without passing through the swirl of water 32. In the illustrated embodiment, guide vanes 36 are disposed in the upper region of the annular air outlet opening 25. These guide vanes 36 insure a good distribution of the humidified and purified air with the ambient air, since they deliver a laminar discharge.

Figure 2:
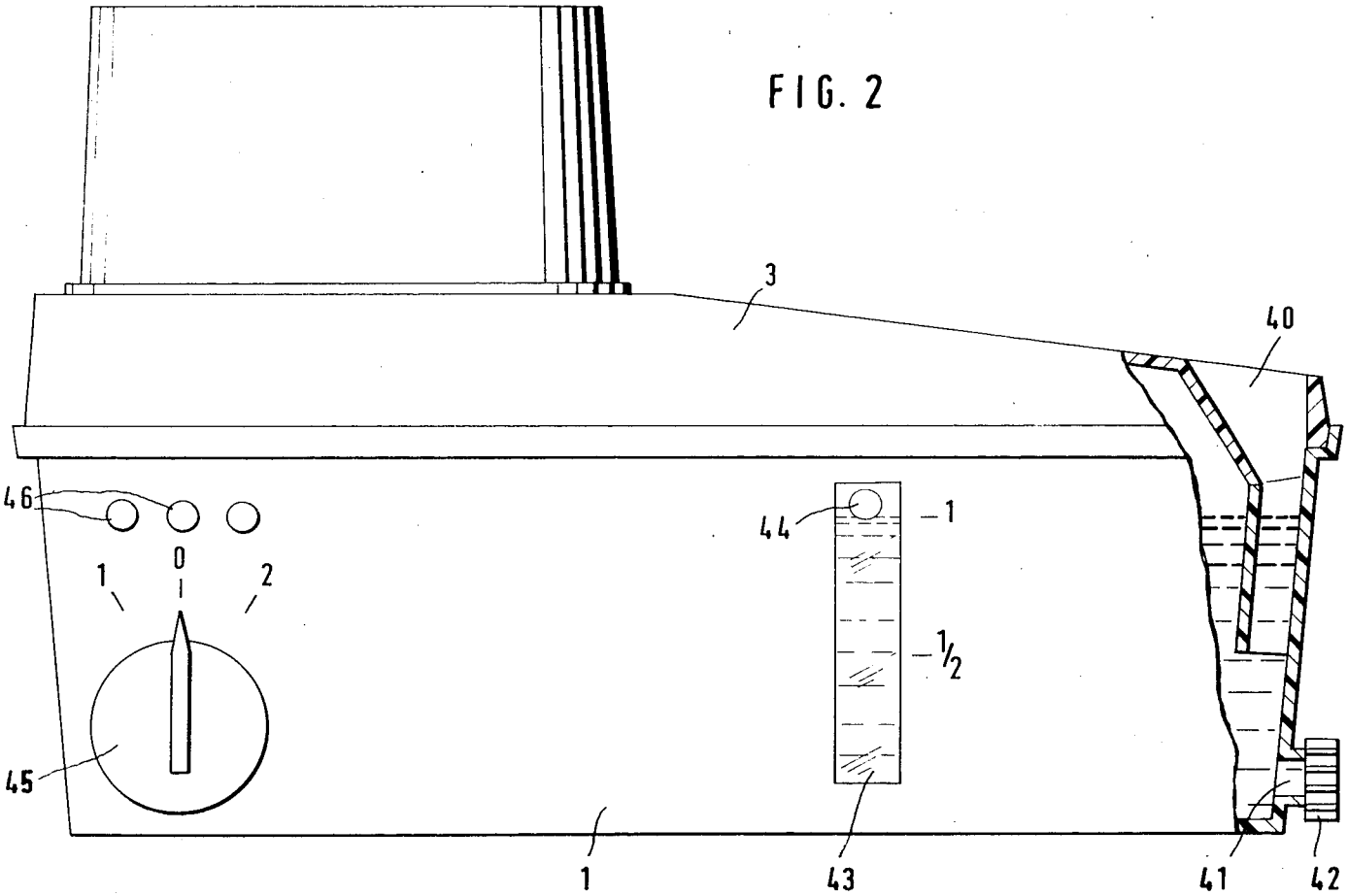
FIG. 2 is a partially broken away and sectioned side view of the apparatus of FIG. 1.

As can be seen in *FIG. 2*, the inventive apparatus also has a condition of filling indicator 43 with a float ball 44 that indicates the water level within the supply tank 1. A closeable filling opening 40 is provided on the apparatus to refill the tank with water. The apparatus is also provided with a lower outlet 41 that can be closed off by screwing a cap 42 thereon. The desired operating condition can be maintained with a control and adjustment device 45 and indicator lights 46; the setting can thereby be read from the outside.

The one-piece construction of the rotor with the fan wheels 7 and 8 is particularly advantageous; however, the aforementioned parts can also be individually mounted on the drive shaft 6. In such a case, the rotor 9 should be embodied in such a way that the previously described guidance of the stream of water 33 via the pump tube 9 is still retained through the annular channel 15 to the outlet channels 20 after the direction is changed by 180°. This construction is particularly advantageous, since in this way a high acceleration of the stream of water 32 up to discharge from the outlet channels 20 results, as a result of which a freer, flatter swirl of water is produced within the supply tank, through which swirl of water the air flow 34 is conveyed for purifying and humidifying the latter.

The present invention is, of course, in no way restricted to the specific disclosure of the specification and drawings, but also encompasses any modifications within the scope of the appended claims.

What is claimed is:

1. An apparatus for humidifying and purifying the air of a room, said apparatus comprising:

a housing that includes air inlet means and air outlet means, with a lower part of said housing being embodied as a trough-like part that has a base and that serves for holding a liquid, with a free space being formed in said housing above the surface of liquid therein;

first fan wheel means disposed in said housing for generating an air flow therethrough;

pump means disposed in said housing for producing a liquid flow therewithin;

means disposed in said housing and cooperating with said pump means to receive therefrom said liquid flow, and to form from the latter a freely forming sheet-like stream of liquid in said free space above said liquid level, with said air inlet means cooperating with said free space in such a way that said air flow generated by said first fan wheel means is directed completely through said sheet-like stream of liquid, with said air outlet means being disposed downstream of the latter;

said pump means including a rotor which has an axis of rotation and is in the form of a conical tube that tapers downwardly in the direction toward said trough base and has a liquid inlet opening disposed above said trough base and below said liquid level, with said pump rotor tube, above said liquid level, being provided with cooperating means, which includes approximately radially directed discharge channels for said sheet-like stream of liquid, which is in the form of a swirl of liquid, with said discharge channels opening into said free space and being disposed in a star-like manner about said axis of rotation of said rotor tube and approximately at right angles thereto, said discharge channels furthermore being disposed below said air outlet means in such a way that the latter can be completely shielded from said swirl of liquid;

said cover having an underside on which is disposed a circumferential rib for laterally delimiting the stream range of all of said discharge channels and extending to a location in a level between said discharge channels and said liquid level;

said air outlet means, when viewed from above, being disposed inwardly of said circumferential rib;

said air inlet means, when viewed from above, being disposed in said cover outwardly of said circumferential rib and adjacent thereto;

said rotor tube having an upper end remote from said trough base; and which includes, as part of said cooperating means, a member that surrounds said upper end of said rotor tube and is rigidly connected to the latter, with said member being spaced from said rotor tube in such a way as to form, as a further part of said cooperating means, an annular channel that from said upper end of said rotor tube runs downwardly and outwardly opening into said discharge channels;

said cooperating means further including an annular disk on the outer surface of said rotor tube, said disk being disposed below said member that is riqidly connected to said rotor tube, and being spaced from said member to form a horizontally, extending gap, with said discharge channels being formed by said gap and by ribs that interrupt said gap and interconnect said member and said annular disk; and a second fan wheel means disposed on said drive shaft of said motor for cooling the latter, with said first fan wheel means, said second fan wheel means, and said rotor tube all being embodied as a single component, said first fan wheel means being coaxially disposed about said second fan wheel means, with said first and second fan wheel means being connected to said rotor tube via said member that surrounds the latter, said discharge channels being located below said first and second fan wheel means.

2. An apparatus according to claim 1, in which said pump means includes a rotor which has an axis of rotation and is in the form of a conical tube that tapers downwardly in the direction toward said trough base and has a liquid inlet opening disposed above said trough base and below said liquid level, with said pump rotor tube, above said liquid level, being provided with said cooperating means, which includes approximately radially directed discharge channels for said sheet-like stream of liquid, which is in the form of a swirl of liquid, with said discharge channels opening into said free space and being disposed in a starlike manner about said axis of rotation of said rotor tube and approximately at right angles thereto, said discharge channels furthermore being disposed below said air outlet means in such a way that the latter can be completely blocked off from said swirl of liquid.

3. An apparatus according to claim 1, in which said housing is a two-part housing, including said lower trough-like part, and a cover placed thereon, with said air inlet and outlet means being opening means in said cover; and which includes an air filter disposed in said cover, downstream of said air inlet means and upstream of said free space, for preliminary purification of said air flow.

4. An apparatus according to claim 3, in which said pump means includes a drive motor that is disposed in said cover and has a drive shaft on which are seated said first fan wheel means, and therebelow said rotor tube; and in which said air outlet means is disposed annularly about said drive motor.

5. An apparatus according to claim 4, in which a drop separator is disposed in said housing, in the path of said air flow, upstream of said of said air outlet means and downstream of said swirl of liquid.

6. An apparatus according to claim 5, in which said housing is provided with liquid inlet and outlet means.

7. An apparatus according to claim 6, in which said housing is provided with a liquid level indicator.

8. An apparatus according to claim 5, in which said air outlet means is provided with guide surface means to impart a laminar discharge to said air flow.

9. An apparatus according to claim 4, which includes a second fan wheel means disposed on said drive shaft of said motor for cooling the latter.

10. An apparatus according to claim 4, in which said housing is provided with a control and adjustment device, and a cooperating indicator, for maintaining presettable parameters.

11. An apparatus according to claim 4, in which said housing has smooth inner surfaces.

12. An apparatus according to claim 4, in which said cover has an underside on which is disposed a circumferential rib for laterally delimiting the stream range of all of said discharge channels.

13. An apparatus according to claim 12, in which said air outlet means, when viewed from above, is disposed inwardly of said circumferential rib.

14. An apparatus according to claim 13, in which said air inlet means, when viewed from above, is disposed in said cover outwardly of said circumferential rib and adjacent thereto.

15. An apparatus according to claim 4, in which said rotor tube has an upper end remote from said trough base; and which includes, as part of said cooperating means, a member that surrounds said upper end of said rotor tube and is rigidly connected to the latter, with said member being spaced from said rotor tube in such a way as to form as a further part of said cooperating means, an annular channel that from said upper end of said rotor tube runs downwardly and outwardly, opening into said discharge channels.

16. An apparatus according to claim 15, in which said cooperating means further includes an annular disk on the outer surface of said rotor tube, said disk being disposed below said member that is rigidly connected to said rotor tube, and being spaced from said member to form a horizontally extending gap, with said discharge channels being formed by said gap and by ribs that interrupt said gap and interconnect said member and said annular disk.

17. An apparatus according to claim 16, which includes a second fan wheel means disposed on said drive shaft of said motor for cooling the latter, with said first fan wheel means, said second fan wheel means, and said rotor tube are all embodied as a single component.

18. An apparatus according to claim 17, in which said first fan wheel means is coaxially disposed about said second fan wheel means, with said first and second fan wheel means being connected to said rotor tube via said member that surrounds the latter.

19. An apparatus according to claim 1, wherein said conical tube has a diameter that increases from top to bottom so that said annular channel is formed therewith relative to said cooperating means including said member spaced therefrom, said conical tube extending upwardly to within said second fan wheel means where said conical tube ends at a distance from said annular disk.

20. An apparatus according to claim 1, wherein said annular disk has a downwardly directed, hollow cylindrical part with which said annular disk as well as said first and second fan wheel means and said conical tube that are fixedly connected thereto are nonrotatably connected to said drive shaft of said motor.

21. An apparatus according to claim 1, wherein said cooperating means includes a further annular disk connected to a bottom of an approximately hollow cylindrical part on an outside thereof and radially extending ribs interconnected to said annular disks so that said discharge channels are formed between said disks.

22. An apparatus according to claim 1, wherein a plurality of fan blades are disposed radially relative to the axis of rotation and that form said second fan wheel means located between an inner hollow cylindrical part, said further annular disk and an outer hollow cylindrical part.

* * * * *